US008205404B2

(12) United States Patent
Vermeulen et al.

(10) Patent No.: US 8,205,404 B2
(45) Date of Patent: Jun. 26, 2012

(54) COVERING PANEL WITH BEVELLED EDGES HAVING VARYING CROSS-SECTION, AND APPARATUS AND METHOD OF MAKING THE SAME

(75) Inventors: Bruno Paul Louis Vermeulen, Aldeneik-maaseik (BE); Jan Eddy De Rick, Geraardsbergen (BE)

(73) Assignee: Spanolux N.V.-Div. Balterio, Sint-Baafs-Vijve (BE)

( * ) Notice: Subject to any disclaimer, the term of this patent is extended or adjusted under 35 U.S.C. 154(b) by 0 days.

(21) Appl. No.: 12/440,812

(22) PCT Filed: Sep. 11, 2007

(86) PCT No.: PCT/EP2007/059544

§ 371 (c)(1),
(2), (4) Date: May 11, 2009

(87) PCT Pub. No.: WO2008/031829

PCT Pub. Date: Mar. 20, 2008

(65) Prior Publication Data

US 2010/0000172 A1 Jan. 7, 2010

(30) Foreign Application Priority Data

Sep. 11, 2006 (EP) ..... 06120427
Feb. 20, 2007 (EP) ..... 07102710

(51) Int. Cl.
*B44F 7/00* (2006.01)
*B44F 9/02* (2006.01)
*E04C 1/00* (2006.01)

(52) U.S. Cl. ..... 52/311.2; 52/313; 52/578; 52/581; 52/588.1

(58) Field of Classification Search ..... 52/578–588.1, 52/590.1–590.3, 591.1–591.5, 592.1–592.6, 52/506.05, 311.1, 311.2, 313, 316
See application file for complete search history.

(56) References Cited

U.S. PATENT DOCUMENTS 1,551,544 A * 9/1925 crooks ..... 52/578
(Continued)

FOREIGN PATENT DOCUMENTS

DE 4243981 7/1993
(Continued)

OTHER PUBLICATIONS

Official Search Report of the European Patent Office Patent Office in counterpart foreign application No. PCT/EP2007/059544 filed Sep. 11, 2007.

(Continued)

*Primary Examiner* — Jeanette E. Chapman
(74) *Attorney, Agent, or Firm* — Steven M. Koehler; Westman, Champlin & Kelly, P.A.

(57) ABSTRACT

A panel for use in an assembly of panels is attached to each other to form a covering. The panel comprises an upper surface and a lower surface each extending within a different main plane, and at least an edge between these surfaces comprising a coupling to couple the panel to a coupling of another panel. The upper surface includes a lowered part at said edge and the cross-section of the lowered part, perpendicular to the edge of the panel, varies along the edge. Such a panel provides a good imitation of a panel made of natural materials. The invention also provides an appropriate method to make such a panel.

20 Claims, 7 Drawing Sheets

U.S. PATENT DOCUMENTS

| | | | | |
|---|---|---|---|---|
| 3,204,380 | A * | 9/1965 | Wilson et al. | 52/309.15 |
| 3,998,014 | A * | 12/1976 | Bartels et al. | 52/100 |
| 5,302,873 | A | 4/1994 | Takei | |
| 5,570,554 | A * | 11/1996 | Searer | 52/539 |
| 5,630,304 | A * | 5/1997 | Austin | 52/384 |
| 5,755,068 | A * | 5/1998 | Ormiston | 52/314 |
| 7,137,229 | B2 * | 11/2006 | Pervan | 52/313 |
| 7,377,081 | B2 * | 5/2008 | Ruhdorfer | 52/588.1 |
| 7,516,588 | B2 * | 4/2009 | Pervan | 52/592.1 |
| 7,621,092 | B2 * | 11/2009 | Groeke et al. | 52/586.1 |
| 7,641,963 | B2 * | 1/2010 | Grafenauer | 428/212 |
| 2002/0100231 | A1 * | 8/2002 | Miller et al. | 52/177 |
| 2004/0035078 | A1 | 2/2004 | Pervan | |
| 2006/0048474 | A1 | 3/2006 | Pervan | |
| 2006/0138897 | A1 | 6/2006 | Hess | |
| 2006/0174566 | A1 * | 8/2006 | Tsukada | 52/384 |
| 2007/0175160 | A1 * | 8/2007 | Groeke et al. | 52/588.1 |
| 2007/0245663 | A1 * | 10/2007 | Hahn et al. | 52/506.01 |
| 2007/0261350 | A1 * | 11/2007 | Hahn et al. | 52/582.1 |
| 2008/0000190 | A1 * | 1/2008 | Hakansson | 52/588.1 |

FOREIGN PATENT DOCUMENTS

| | | | |
|---|---|---|---|
| DE | 20313350 | | 12/2003 |
| DE | 10229134 | | 1/2004 |
| FR | 2671510 | A1 * | 7/1992 |
| NL | 8701426 | A * | 1/1989 |
| WO | WO 03/078761 | | 9/2003 |
| WO | WO 2005/002784 | | 1/2005 |
| WO | WO 2006/031169 | | 3/2006 |
| WO | WO 2006/066776 | | 6/2006 |

OTHER PUBLICATIONS

Written Opinion of the European Patent Office Patent Office in counterpart foreign application No. PCT/EP2007/059544 filed Sep. 11, 2007.

* cited by examiner

COVERING PANEL WITH BEVELLED EDGES HAVING VARYING CROSS-SECTION, AND APPARATUS AND METHOD OF MAKING THE SAME

CROSS-REFERENCE TO RELATED APPLICATION

The present application is a national stage filing of international patent application Serial No. PCT/EP2007/059544, filed Sep. 11, 2007, and published as WO 2008/031829 in English.

BACKGROUND

The discussion below is merely provided for general background information and is not intended to be used as an aid in determining the scope of the claimed subject matter.

The invention relates to a panel for use in an assembly of panels attached to each other to form a covering, comprising an upper surface and a lower surface each extending within a different main plane, and at least an edge between these surfaces comprising a coupling to couple the panel to of another panel, wherein the upper surface includes a lowered part at said edge of the panel.

The invention also relates to a method of making such panels.

Such panels are known in various embodiments, for example in the form of laminate floor panels. Such panels are made on a wood basis and have a decorating layer mostly to imitate natural panels made from wood or other natural materials.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter.

An aspect of the invention provides a panel of which the cross-section of the lowered part, perpendicular to the edge of the panel, varies along the edge.

Due to this feature the lowered part has a non-planar structure along the edge, which improves the natural appearance of a panel. The advantage is that the panels according to the invention provide a better imitation of natural panels than those having a flat lowered part.

The cross-section of the lowered part may vary along the length of the edge in an irregular, preferably random manner, for example a rustical design. This improves the natural appearance of a panel still further.

The lowered part may have an extreme edge which is intended to be positioned against an extreme edge of an adjacent panel, which extreme edge has a constant position within each cross-section. As a result of this feature the extreme edge of each of the panels in an assembly of panels can be coupled to each other to form the covering such that the covering is sealed between adjacent panels at the extreme edge. This prevents leakage of water or the like between panels. Moreover, this feature has the advantage that it avoids exposing of a portion of the edge of the panel if the extreme edge of adjacent panels had varying positions at different locations with respect to each other along the edge.

The upper surface of the panel may be provided with a surface decoration, whereas the lowered part may be provided with a surface finishing. This provides the opportunity to apply the production method of providing the surface decoration to the panel such as known in the art, whereas the lowered part can be finished in a separate process.

Alternatively, the invention provides a panel for use in an assembly of panels attached to each other to form a covering, comprising an upper surface and a lower surface each extending within a different main plane, and at least an edge between these surfaces comprising a coupling to couple the panel to a coupling of another panel, wherein the upper surface includes a lowered part at said edge of the panel, the lowered part crossing the main plane of the upper surface along a first line and crossing an extreme edge of the panel which is intended to be positioned against an extreme edge of an adjacent panel along a second line, wherein the extent of the first line deviates from the extent of the second line. In this embodiment the first line between the upper surface and the lowered part may be used to improve the natural appearance of a panel.

The invention also provides a method of making a panel for use in a covering, including the steps of:

providing a panel comprising an upper surface and a lower surface each extending within a different main plane, and at least an edge between these surfaces, machining the edge to form a coupling to couple the panel to a coupling of another panel and to provide the upper surface with a lowered part at said edge of the panel, wherein the edge is machined such that the lowered part is provided with a cross-section perpendicular to the edge of the panel which varies along the edge of the panel.

This method may provide panels having the advantages as mentioned hereinbefore.

The lowered part may be provided with a coating, such as a foil or paint, which has the benefit of protecting the panels against dirt, water and the like. For esthetical reasons it may be of a rustical design, for example.

In a preferred method the upper surface of the panel is provided with a surface finishing before the coating is provided on the lowered part, wherein the finished upper surface is provided with an anti-adhesive before the lowered part is coated, and any coating which is applied on the anti-adhesive is removed together with the anti-adhesive, for example by brushing. The advantage of these steps is that they simplify the method of making panels according to the invention. Since the cross-section of the lowered part along the edge varies, the width of the lowered part as seen in a direction along the edge of the panel may vary. As a consequence, the width of the foil or the amount of paint may vary along the edge of the panel. Due to the application of the anti-adhesive the width of the foil or paint spray may be locally larger than the width of the lowered part as mentioned above, because excessive foil or paint can be removed easily from the upper surface next to the lowered part, for example by brushing. Of course, if no problems are encountered in respect of adherence between the coating and the lowered part other methods of providing a coating on the lowered part are conceivable rather than using an anti-adhesive.

Preferably, the edge is machined by means of a milling tool, which is either moved in a direction towards and away from the edge during milling of the edge, or the milling is effected by means of a rotary milling tool having teeth around its circumference which have a varying distance from the rotary centre of the tool. The advantage of applying this technique is that it provides the opportunity of a fast manufacturing process in order to obtain the desired structure of the lowered part as mentioned hereinbefore, hence minimizing production costs.

BRIEF DESCRIPTION OF THE DRAWINGS

The invention will hereafter be elucidated with reference to the very schematic accompanying drawings.

DETAILED DESCRIPTION OF THE ILLUSTRATIVE EMBODIMENTS

Figure 1:
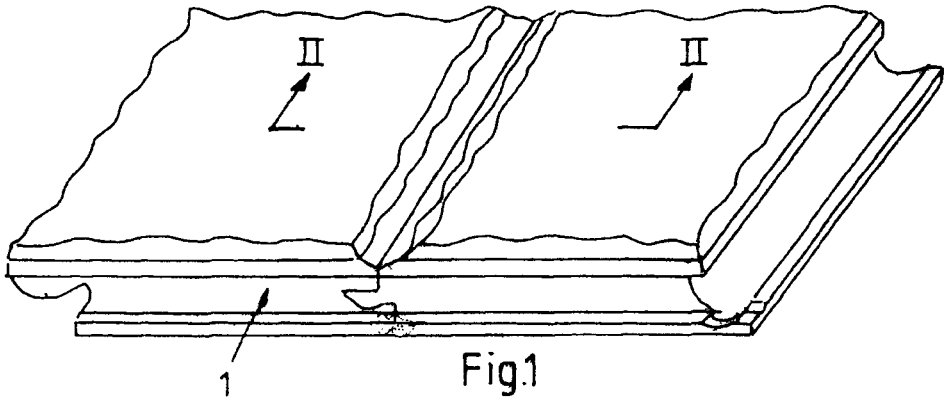
FIG. 1 is a very schematic perspective plan view of two adjacent panels according to the invention.

FIG. 1 illustrates two adjacent panels 1 of one embodiment of the panel according to the invention. The panels 1 as shown in FIG. 1 are attached to each other and may be part of a covering when a plurality of panels are attached to each other in this way. Generally, the panels will be rectangular, either square or elongated or in between. However, other shapes are conceivable.

Figure 2:
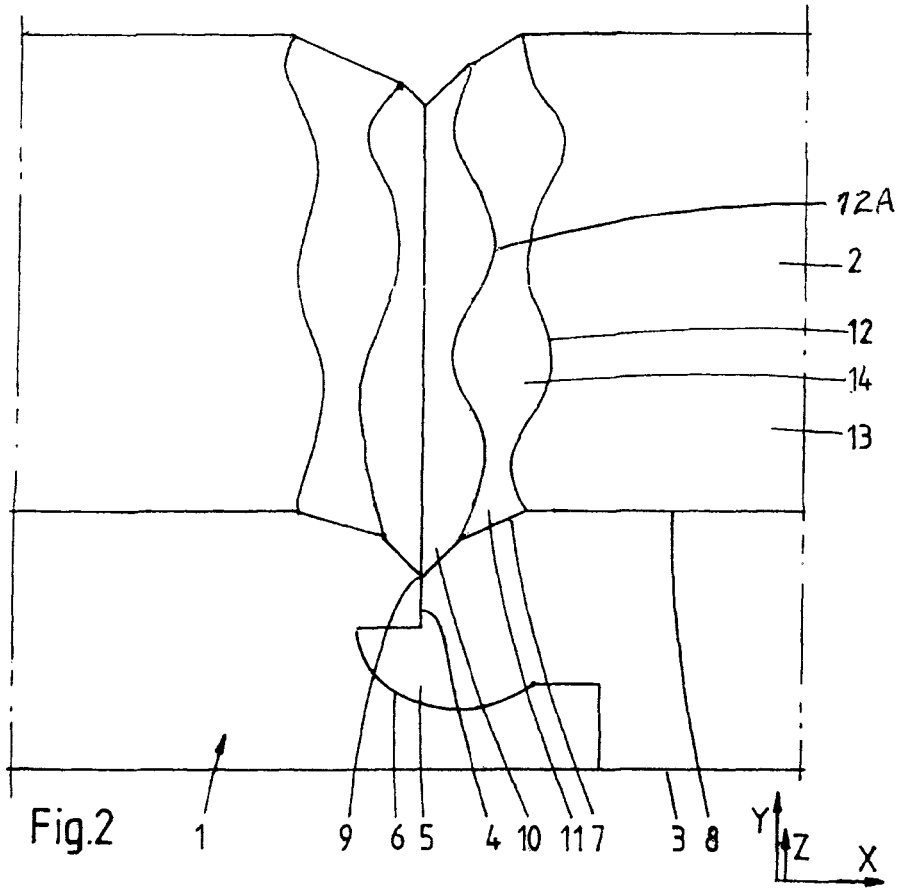
FIG. 2 is a larger-scale perspective cross-section along the line II-II in FIG. 1.

FIG. 2 illustrates a cross-section of the assembly of the panels 1 as shown in FIG. 1 on a larger scale in more detail. Each panel 1 comprises an upper surface 2 and a lower surface 3. These surfaces 2, 3 each extend within different main planes. In the embodiment as shown in FIG. 2, the main portions of the upper surface 2 and lower surface 3 are parallel to each other and spaced in Y direction. The upper and lower surfaces 2, 3 are substantially flat surfaces. The panel comprises an edge 4 between both surfaces. The edge 4 is provided with a coupling to couple the panel 1 to a coupling of the adjacent panel 1, such as shown in FIG. 2. The coupling is well-known in the art, for example formed by a tongue 5 and groove 6 and are not part of the present invention. Of course, it is possible to provide the panel 1 with various kinds of couplings and locking devices for attaching the panels 1 to each other.

The upper surface 2 includes a lowered part 7 on at least one, but preferably all edges 4 of the panel. FIG. 2 shows that the upper surface 2 comprises a substantially flat surface portion 8 and the lowered part 7. The lowered part 7 is located below the flat surface portion 8 of the upper surface 7 as seen in Y direction.

The upper surface 2 of the panel 1 is provided with a surface decoration which imitates natural materials, such as wood. This surface decoration may include a laminate of paper layers impregnated with resin. The remaining part of the panel 1 below the upper surface 2 may include a core comprising one or more layers of MDF, HDF, HTSP, PVC, composites or the like, and possibly a balancing layer.

The cross-section of the lowered part 7, perpendicular to the edge of the panel, varies along the edge 4. In FIG. 2 the edge 4 extends in Z direction. It can be seen that the lowered part 7 has a non planar structure as seen along the edge 4. This provides a natural appearance of the panels 1. The embodiment of the panel 1 as shown in FIG. 2 has a lowered part 7 of which the cross-section varies in an irregular manner. Preferably, it varies in a random manner so as to provide a most natural look of the panel 1.

In the embodiment as shown in FIG. 2 the lowered part 7 has an extreme edge 9, which is positioned against an extreme edge 9 of the adjacent panel 1. The extreme edge 9 is straight and therefore has the same position within each cross-section so as to obtain an appropriate sealing between adjacent panels 1. It can be seen in FIG. 2 that the extreme edge 9 has a fixed position with respect to the lower surface 3 since the extreme edge 9 extends parallel to the lower surface 3 and the upper surface 2, whereas the rest of the lowered part 7 varies in a random manner.

In the embodiment of FIG. 2 the lowered part 7 has an inclined extent as seen from the extreme edge 9 to the upper surface 2. This results in a V-groove between the panels 1 when they are attached to each other. Furthermore, a lower section 10 of the V-groove, I which is adjacent to the extreme edge 9 has a planar shape and a varying cross-section along the edge 4. An upper section 11 of the lowered part 7, which is located between the lower section 10 and the flat surface portion 8 of the upper surface 2, has a varying cross-section along the edge 4 The angle of the lower section 10 with respect to the upper surface 2 is larger than the angle of the upper section 11 with respect to the upper surface 2 for example 35-85° and 15-40°, respectively, but other angles are also possible, of course. The width of the lowered part 7 in the X, Y plane along the edge 4 may vary around 2 mm, for example, but other dimensions are conceivable, of course.

FIG. 2 also shows that the lowered part 7 crosses the upper surface 2 in a first line 12, while a line 12A seperates the lower section 10 from the upper section 11. The extreme edge 9 forms a second line. It can be seen that lines 12 and 12A deviate from that of the extreme edge 9 so as to form the desired non-planar structure of the lowered part 7.

The panel 1 such as described hereinbefore can be made by the following steps: machining the edge 4 to form a coupling 5, 6; providing the upper surface 2 with a lowered part 7 at the edge 4; and machining the edge 4 such that the lowered part 7 is provided with a varying cross-section perpendicular to the edge 4 of the panel 1. The structure of the lowered part 7 in FIG. 2 can be obtained by performing the following steps: first machining the flat lower section 10 by passing the panel 1 along a milling tool which has a fixed position with respect to the passing panel 1, then passing the panel 1 along a milling tool which is moved in a direction towards and from the panel 1 so as to form the upper section 11.

Figure 2A:
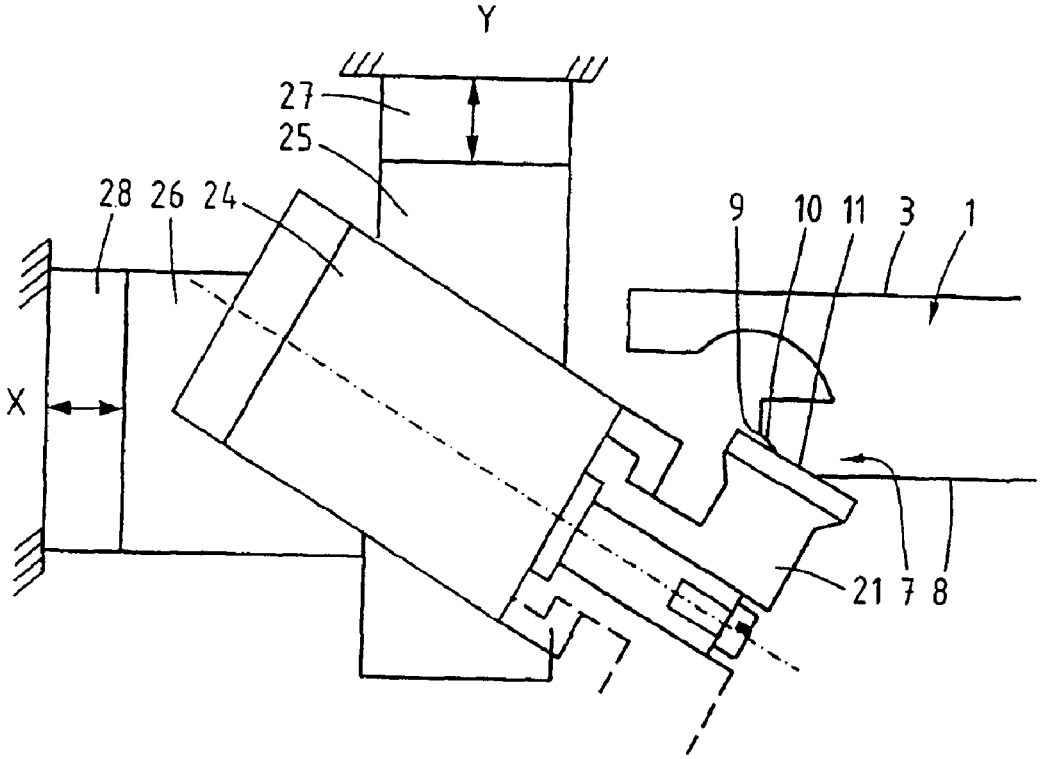
FIG. 2*a* is a very schematic side view of an alternative embodiment of a milling tool for machining the edge of a panel to form the lowered part.

One way of moving the milling tool is by moving it rectilinearly in X and/or Y-direction. This can be done by moving the tool through a motor (induction, linear etc.), pneumatically, hydraulically, mechanically in a controlled (random) manner. However, it is also conceivable to cause the movements by means of piezo electric elements or actuators or a linear motor in combination with a magnet which may be supported by a resilient member. For example, one or more piezo elements can be mounted between a machine support and the motor for moving the tool(s) in one or more directions. If more than one piezo element is used, these elements can be used in parallel or in series. FIG. 2*a* shows an arrangement including a milling tool 21 attached to a motor 24 which is mounted on a support 25 and 26 which are each movable in directions perpendicular to each other. Each of the supports is connected to a piezo electric element 27, 28, respectively which are mounted to a fixed base. The fixed base for element 27 may also be formed by support 26, so as to allow independent movements of the supports 25 and 26 in X and Y direction to create the desired shape of the lowered part 7 of the panel edge (in this case the upper part 11 thereof) when the milling tool 21 and the lowered part 7 are moved along each other.

Figure 3A:
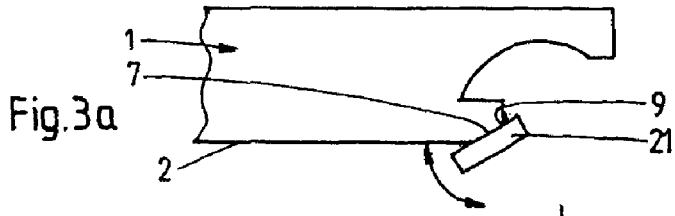
FIG. 3*a* is a very schematic side view of a panel, illustrating an alternative machining step, showing the panel upside down.
Figure 3B:
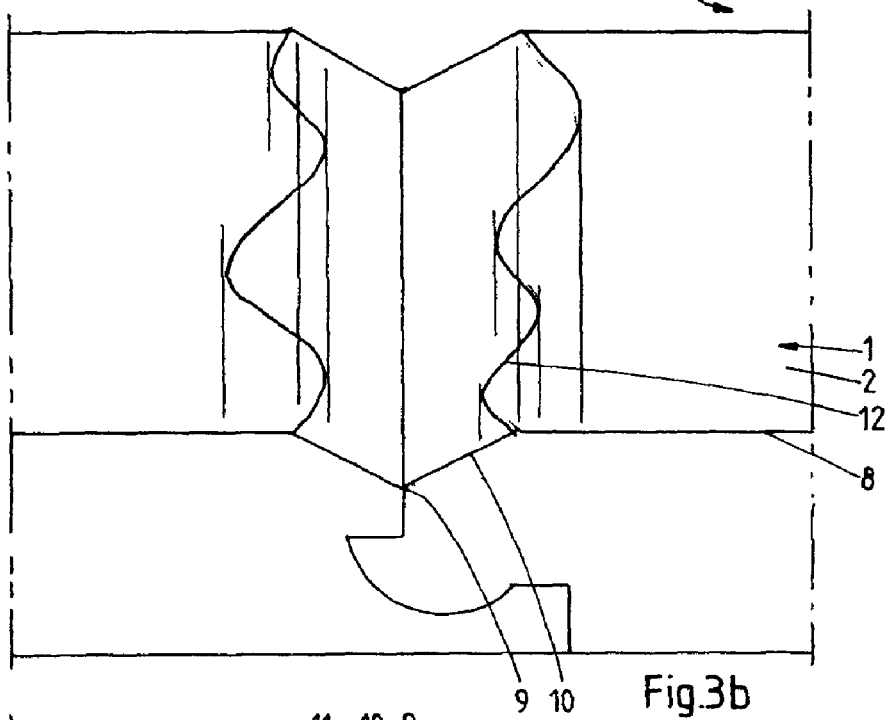
FIG. 3*b* is a smaller-scale view as shown in FIG. 2, illustrating adjacent panels which are manufactured according to the alternative machining step as illustrated in FIG. 3*a*.

The lowered part 7 can also be made in a single machining step. This is illustrated in FIG. 3*a*. The lowered part 7 is made by the milling tool 21, which has a fixed position with respect to the position of the extreme edge 9 of the panel 1. The milling tool 21 can be swivelled about the extreme edge 9 such as shown by the double-headed arrow in FIG. 3*a*. This alternative machining method results in panels having a lowered part 7 which has a non-planar structure between the first line 12 and the extreme edge 9 which has maintained its original shape, in this case a straight line. This machining method results in a panel 1 such as illustrated in FIG. 3*b*.

Figure 3C:
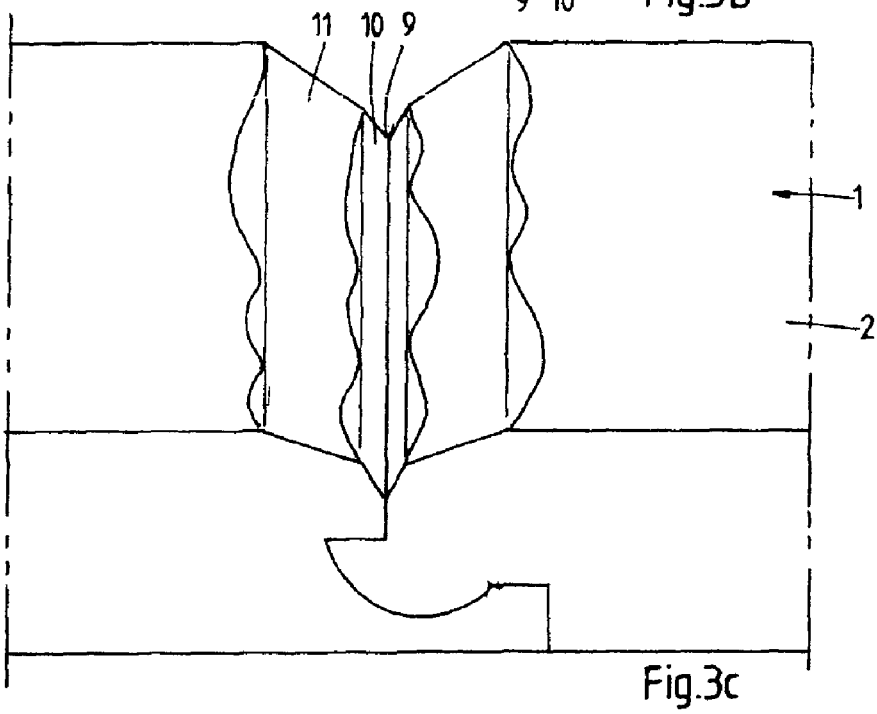
FIG. 3*c* is a view as shown in FIG. 2, illustrating adjacent panels which are manufactured according to still another alternative machining step.

Referring to FIG. 3*a*, it is also possible to swivel the milling tool 21 about a line extending parallel to the extreme edge 9 between the extreme edge 9 and the upper surface 2. This results in a panel 1 such as illustrated in FIG. 3*c*. In this case the inclined lower section 10 is machined by a preceding machining step.

The piezo electric elements may also be used to create the swivel movement of the milling tool by placing the element(s) in an appropriate manner with respect to the milling tool or motor for actuating it.

Normally, the upper surface 2 of a large plate of which panels 1 will be sawn off later on, is initially provided with a surface decoration 13 before the panels 1 are sawn off. After machining the edge 4 to make the lowered part 7, the lowered part 7 is preferably provided with a surface finishing, such as a coating 14 comprising a foil 14*a* or paint. This protects the material of the panel 1 against dirt and liquids or the like which might permeate into the panel 1. It also provides the lowered part 7 with a color or decoration which is adapted to the decoration of the upper surface of the panel.

Since the cross-section of the lowered part 7 of the panel 1 along the edge 4 varies, the required amount of coating 14 or paint per unit of length along the edge 4 to be provided to the lowered part 7 varies along the edge 4, as well. The surface finishing can be provided onto the upper surface 2 before the coating 14 is provided onto the lowered part 7, whereas the finished upper surface 2 is provided with an anti-adhesive before the lowered part 7 is coated. After coating the lowered part 7 a part of the coating 14 may have been provided onto the upper surface 2 next to the lowered part 7 (the flat surface portion 8) which was already covered by the anti-adhesive. The remaining coating 14 on the upper surface 2 can be easily removed from the upper surface 2 together with the anti-adhesive by brushing, for example.

Figure 4A:
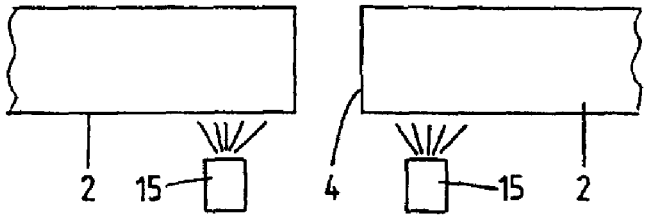
FIGS. 4*a*-4*c* are very schematic sectional views of two panels in different manufacturing steps, showing the panels upside down.
Figure 4B:
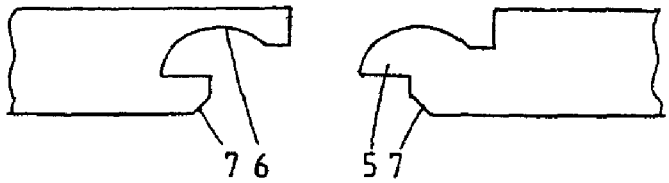
Figure 4C:
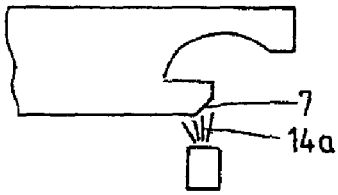

Preferably, the anti-adhesive is provided onto the upper surface 2 before machining the edge to form the lowered part 7, because in this case the lowered part 7 is automatically made free of anti-adhesive during machining, whereas the flat surface portion 8 remains covered with the anti-adhesive. These steps are illustrated in FIG. 4. FIG. 4*a* shows that the upper surfaces 2 of two panels 1 are covered by anti-adhesive near the edges before machining the edges 4 and forming the lowered part 7 (note that the panels are shown upside down in FIG. 4). The anti-adhesive can be provided onto the upper surface 2 by using a spraying apparatus 15. FIG. 4*b* illustrates the panels 1 after the coupling 5, 6 and the lowered part 7 have been provided. FIG. 4*c* illustrates the process of providing a foil 14*a* as a coating 14 onto the lowered part 7.

Figure 5A:
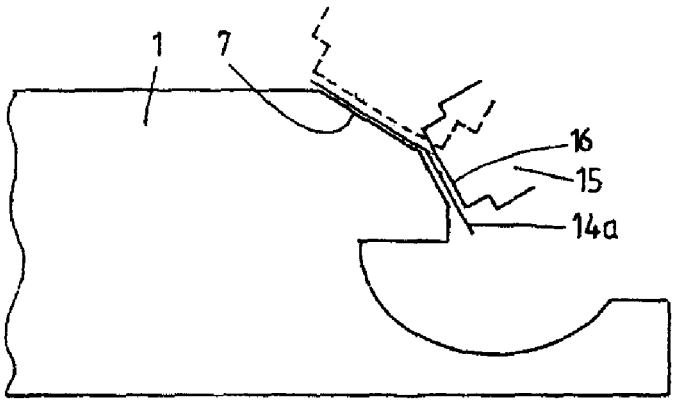
FIGS. 5*a*-5*b* are very schematic sectional views of a panel and a press tool, illustrating the process of fixing a foil to the lowered part.
Figure 5B:
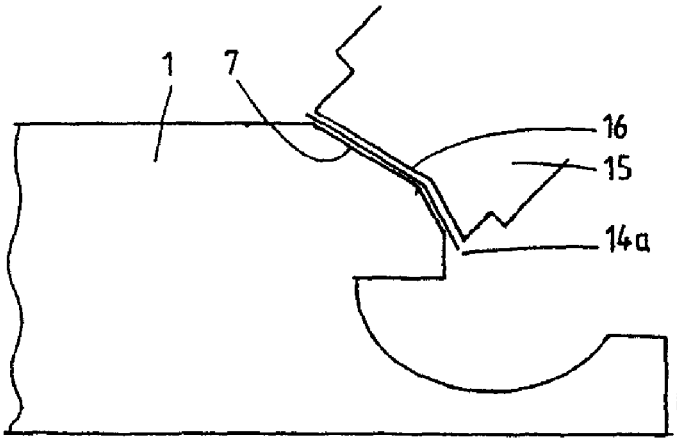

FIGS. 5*a* and 5*b* illustrate the process of providing a foil 14*a* to the lowered surface 7 in more detail. FIG. 5*a* illustrates the process of pressing the foil 14*a* onto the panel 1 by two separate pressing tools 15 behind each other as seen in the direction along the edge 4. Each of the pressing tools 15 have substantially flat pressing surfaces 16, which can be angled with respect to each other so as to create a pressing surface 16 corresponding to the shape of the lower part 7. FIG. 5*b* shows the process of pressing the foil 14*a* onto the panel 1 by a single pressing tool 15 which has a deformable pressing surface 16 which adapts to the varying shape of the lowered part 7.

Figure 6A:
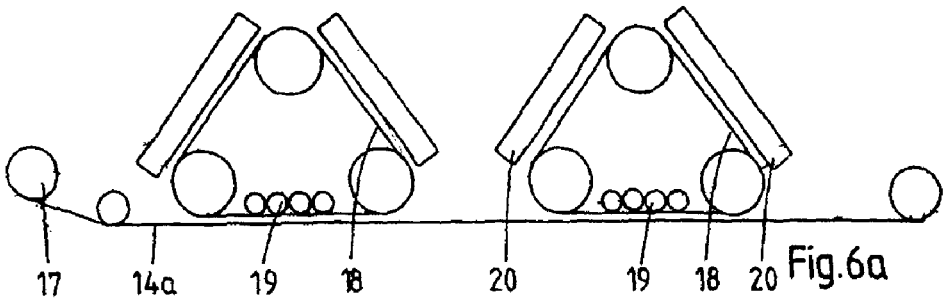
FIG. 6*a* is a very schematic side view of an apparatus for providing and adhering foils on a lowered part of a panel.
Figure 6B:
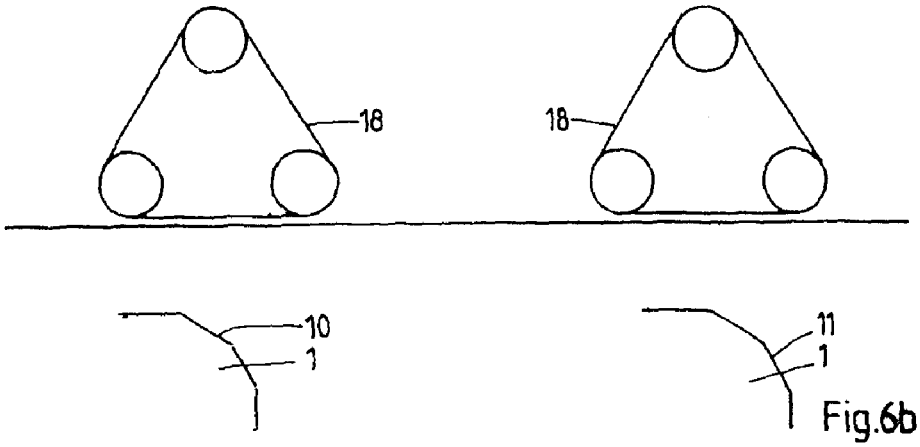
FIG. 6*b* is a view which is partly similar to FIG. 6*a*, in which the way of pressing two different portions of a panel is illustrated.
Figure 6C:
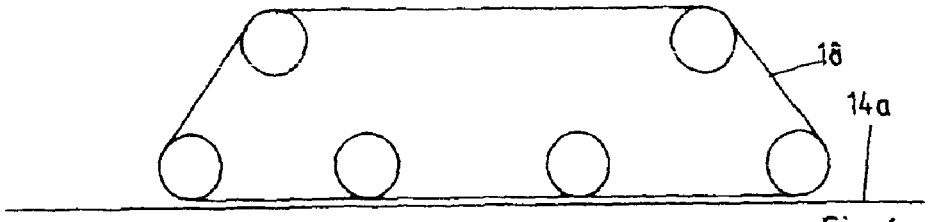
FIG. 6*c* is a very schematic side view of an apparatus nearly similar to that shown in FIG. 6*b*, but including a single belt.

FIG. 6*a* is a very schematic side view of an apparatus for providing a foil on a lowered part 7 of a panel 1. A foil strip 14*a* is supplied from the left side by a roller 17 comprising a foil strip 14*a*. The foil strip 14*a* has a width of 8-10 mm, for example, but other dimensions are conceivable. The panels 1 are also supplied from the left side (not shown) and are conveyed from left to right at the same speed as the speed of the foil strip 14*a*. FIG. 6*a* also shows that the apparatus comprises pressing belts 18 and pressing rollers 19 which press the belt 18 against the foil 14*a* onto the lowered part 7 of the panel 1. The apparatus also comprises heating elements 20 to support an adhering process of the foil strip 14*a* to the panel 1. The heating elements 20 are able to keep the temperature of the foil at a constant level during the adhering process. Furthermore, FIG. 6*a* shows two belts for the case that the lowered part 7 is provided with a lower section 10 and an upper section 11 each having different angles with respect to the upper surface 2, such as illustrated in FIG. 5*a*. One belt 18 can be applied for pressing the foil to the lower section 10 and the other belt 18 can be applied for pressing the foil 14*a* to the upper section 11. This is illustrated in FIG. 6*b*. Alternatively, the apparatus can be provided with only one deformable endless belt 18 and pressing rollers 19 wherein axes of rotation of the pressing rollers 19 can be tilted with respect to each other such that the belt 18 is pressed on a lowered part 7 of which the lower section 10 and the upper section 11 have different angles with respect to the upper surface 2, such as shown in FIG. 5*b*. Such an apparatus is illustrated in FIG. 6*c*. In this apparatus the orientation of a portion of the belt 18 which presses on the foil 14A is changed along its direction of movement between the left set of wheels and the right set of wheels in FIG. 6*c*.

Figure 6D:
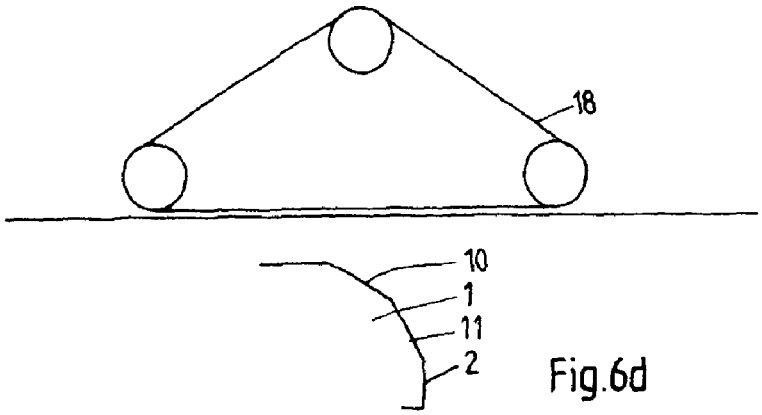
FIG. 6*d* is a very schematic side view of an apparatus nearly similar to that shown in FIG. 6*c*, but including a shorter single belt as seen in a direction of movement, illustrating the way of pressing two different portions of a panel synchronously.

Another alternative embodiment of the apparatus comprises a pressing belt 18, which is able to press the foil synchronously on the lower section 10 and the upper section 11 which have different angles with respect to the upper surface 2, such as illustrated in FIG. 6*d*. In this case the pressing belt 18 is made of a more flexible material.

Figure 7:
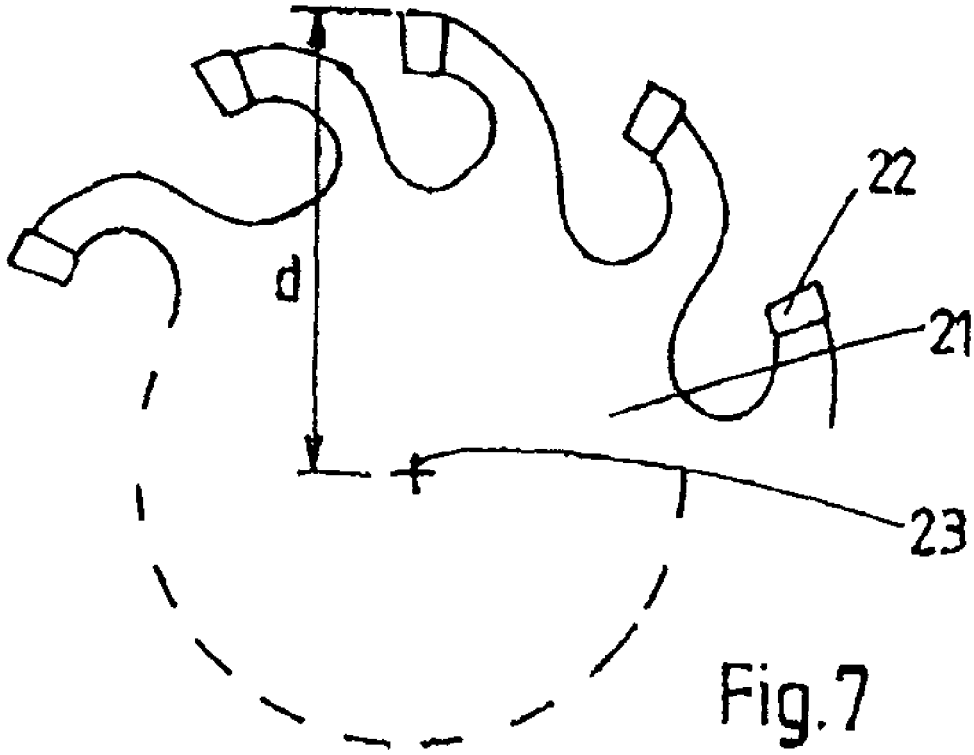
FIG. 7 is a very schematic side view of an embodiment of a milling tool for machining the edge of a panel to form the lowered part.

The non-planar structure of the lowered part 7 is made by machining the edge 4 by a milling tool 21, which can be moved in a direction towards and away from the edge 4, and along the edge 4 at the same time. This method results in a structure of the lowered part 7, such as shown in FIG. 2. An alternative method has been explained above with reference to FIG. 3*a*. It is also possible to apply a rotary milling tool 21, such as shown in FIG. 7. This embodiment of the milling tool 21 is provided with teeth 22 around its circumference, which have a varying distance d with respect to a rotary centre 23 of the milling tool 21. This provides the possibility to vary the amount of material which is cut by the milling tool by changing the rotational position of the milling tool 21 during passing of a panel 1 along the milling tool 21 while the rotary center remains at the same location.

Figure 8:
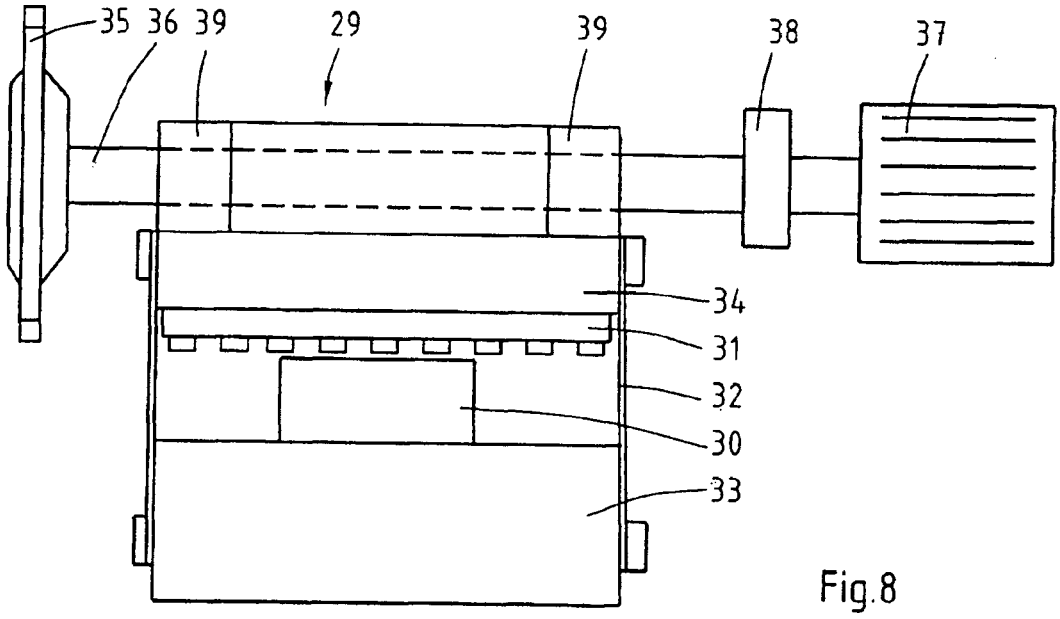
FIG. 8 is a very schematic side view of an alternative embodiment of a milling tool for machining the edge of a panel to form the lowered part.

Another alternative embodiment of a milling tool 29 is shown very schematically in FIG. 8. The embodiment is provided with a linear electric motor 30, a magnet 31, a leaf spring 32, a first support 33 for supporting the magnet 31 via leaf springs 32 and a second support 34. The magnet 31 is fixed to the second support 34. The linear motor 30 has a fixed location, for example to a frame (not shown). The embodiment 29 is further provided with a tool 35, such as a milling tool, which is fixed to a shaft 36. The shaft is driven by a drive motor 37, in this case via a coupling member 38. The shaft 36 is rotatably coupled to the support 34 via bearing members 39.

When the linear motor 30 is activated the magnet 31 is moved with respect to the motor 30. It appears that a fast vibration in the direction along the drive shaft 36 of the tool 35 can be achieved. The vibration is supported by the leaf springs 32. Via the second support 34 the vibration is transferred to the tool 35. Due to the coupling member the shaft 10 may vibrate, whereas the drive motor 37 has a fixed position. The embodiment is not limited to the application of leaf springs 32, but may be provided with equivalent resilient members. It is also conceivable that the magnet 31 is fixed to a frame of the apparatus and the motor is fixed to the second support 34. The embodiment 29 appears to be a relatively simple apparatus for manufacturing a lowered part 7 at the edge of a panel 1, of which the cross-section varies along the edge, in an appropriate way.

Preferably the lowered part is milled within two or more manufacturing steps, for example at 40 and 22.5 degrees with respect to the upper surface, in order to ensure that any opening between two panels is minimized. This reduces the risk of penetration of water or the like between the panels.

From the foregoing it will be clear that the invention provides a panel which presents a very good imitation of a panel made of natural materials. Furthermore, the invention provides an appropriate method to make such a panel.

The invention is not restricted to the above-described embodiments, which can be varied in a number of ways within the scope of the claims. For instance, the first line of the panel may be parallel to the extreme edge, whereas a portion of the lowered part between the first line and the extreme edge is provided with a non-planar structure. Normally, all milling steps on an edge of the panels will performed in one run with several milling tools, but it would be possible to follow another procedure. It is also conceivable to obtain the irregular shape of the lowered part by moving the panel to and fro the milling tool instead of the other way around.

The invention claimed is:

1. A panel for use in an assembly of panels attached to each other to form a covering, comprising, relative to an orthogonal coordinate system having X, Y and Z axes, an upper surface and a lower surface each having planar portions extending within a different main plane parallel to a X-Z plane the Y axis being orthogonal to the X-Z plane, and an edge-between the planar portions of the upper surface and the lower surface includes a coupling to couple the panel to a coupling of another panel, said edge and coupling extending parallel to the Z axis, wherein the upper surface includes a lowered part adjacent said edge of the panel, wherein a shape of the lowered part varies when viewed in cross-sections taken parallel to a X-Y plane at different positions along said one edge, wherein each cross-section is perpendicular to the Z axis.

2. The panel of claim 1, wherein the shape of the lowered part varies in an irregular manner when viewed in cross-sections taken parallel to a X-Y plane at different positions along said one edge.

3. The panel of claim 1, wherein the lowered part has an extreme edge which is intended to be positioned against an extreme edge of an adjacent panel, said extreme edge has a constant position within each cross-section.

4. The panel of claim 1, wherein the lowered part has an inclined extent in order to form a V-groove between the panels.

5. The panel of claim 4, wherein the V-groove has a lower section which has a regular shape along said edge and an upper section which has a varying cross-section, and wherein an angle of the lower section with respect to the planar portion of the upper surface is larger than an angle of the upper section with respect to the planar portion of the upper surface.

6. The panel of claim 1, wherein the upper surface of the panel is provided with a surface decoration, whereas the lowered part is provided with a surface finishing.

7. The panel of claim 1 wherein another edge considered separately from the other edges of the plurality of edges, extends in a second direction, said another edge including a second coupling to couple the panel to a coupling of another panel, and wherein the upper surface includes a lowered part at said another edge of the panel in the second direction, wherein a shape of the lowered part between the upper surface and said one edge varies when viewed in cross-sections at different positions along said another edge, wherein each cross-section is perpendicular to the second direction.

8. A panel for use in an assembly of panels attached to each other to form a covering, comprising, relative to an orthogonal coordinate system having X, Y and Z axes, an upper surface and a lower surface each having planar portions extending within a different main plane parallel to a X-Z plane, and an edge between the planar portions of the upper surface and the lower surface comprising a coupling to couple the panel to a coupling of another panel, said edge and coupling extending to the parallel to the Z axis, wherein the upper surface includes a lowered part adjacent said edge of the panel, the lowered part intersecting the planar portion of the upper surface along a first line that extends generally in a direction as the Z axis, wherein the extent of the first line deviates from said edge.

9. The panel of claim 8, wherein the first line is irregular along the intersection with the planar portion of the upper surface.

10. The panel of claim 8, wherein a position of said edge in each cross-section of the lowered part parallel to a X-Y plane, perpendicular to said edge of the panel and the Z axis, is constant along said edge.

11. The panel of claim 8, wherein the lowered part has an inclined extent in order to form a V-groove between the panels.

12. The panel of claim 11, wherein the V-groove has a lower section along said edge, and wherein an angle of the lower section with respect to the planar portion of the upper surface is larger than an angle of the upper section with respect to the planar portion of the upper surface.

13. The panel of claim 8, wherein the upper surface of the panel is provided with a surface decoration, whereas the lowered part is provided with a surface finishing.

14. A panel for use in an assembly of panels attached to each other to form a covering, comprising, relative to an orthogonal coordinate system having X,Y and Z axes, an upper surface and a lower surface each having planar portions extending within a different main plane parallel to a X-Z plane, the Y axis being orthogonal to the X-Y plane, wherein the upper surface is bounded by a plurality of edges extending along the upper surface and wherein one edge of the plurality of edges, considered separately from other edges of the plurality of edges extends parallel to the Z axis, said one edge including a coupling to couple the panel to a coupling of another panel, and wherein the upper surface includes a lowered part extending along said one edge of the panel parallel to the Z axis, wherein a shape of the lowered part between the planar portion of the upper surface and said one edge varies when viewed in cross-sections taken parallel to a X-Y plane at different positions along said one edge, wherein each cross-section is perpendicular to the Z axis.

15. An assembly comprising a plurality of panels, each panel being arranged to be coupled to other panels so as to form a covering, and each panel comprising, relative to an orthogonal coordinate system having X, Y and Z axes, an upper surface and a lower surface, the upper and lower surfaces each having planar portions extending within a different main plane parallel to a X-Z plane, the Y axis being orthogonal to the X-Z plane, and wherein the upper surface of each panel is bounded by a plurality of edges extending along the upper surface and wherein each edge of at least two opposed edges of the plurality of edges, considered separately from other edges of the plurality of edges extends parallel to the Z axis, each edge of said of at least two opposed edges including a coupling to couple the panel to another panel, and wherein the upper surface of each panel includes a lowered part extending along a corresponding edge of said at least two opposed edges of the panel parallel to the Z axis, wherein a shape of each lowered part between the planar portion of the corresponding upper surface and the corresponding edge varies when viewed in cross-sections taken parallel to a X-Y plane at different positions along the corresponding edge, wherein each cross-section is perpendicular to the Z axis.

16. The panel of claim 15, wherein the shape of each lowered part varies in an irregular manner when viewed in cross-sections taken parallel to a X-Y plane at different positions along each corresponding edge of said at least two opposed edges.

17. The panel of claim 15, wherein each lowered part has an extreme edge disposed between the upper surface and the lower surface of each corresponding panel, wherein each extreme edge is configured to be positioned against an extreme edge of the adjacent panel, and wherein each extreme edge has a constant position within each corresponding cross-section of each lowered part.

18. The panel of claim 15, wherein each lowered part has an inclined extent in order to form a V-groove between the panels.

19. The panel of claim 18, wherein each V-groove has a lower section along each edge of said at least two opposed edges of the panel and an upper section which has a varying cross-section along each edge of said at least two edges, and wherein an angle of each lower section with respect to the planar portion of the corresponding upper surface is larger than an angle of the corresponding upper section with respect to the planar portion of the corresponding upper surface.

20. The panel of claim 15, wherein the upper surface of each panel is provided with a surface decoration, whereas the lowered part of each panel is provided with a surface finishing.

* * * * *